US010118779B2

(12) United States Patent
Miyauchi et al.

(10) Patent No.: US 10,118,779 B2
(45) Date of Patent: Nov. 6, 2018

(54) FEEDER, IMAGE READING APPARATUS AND RECORDING APPARATUS

(71) Applicant: SEIKO EPSON CORPORATION, Tokyo (JP)

(72) Inventors: Keisuke Miyauchi, Kitakyushu (JP); Hiromichi Kitsuki, Kitakyushu (JP); Kosuke Nomoto, Fukutsu (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/631,638

(22) Filed: Jun. 23, 2017

(65) Prior Publication Data

US 2018/0002124 A1 Jan. 4, 2018

(30) Foreign Application Priority Data

Jun. 29, 2016 (JP) ..... 2016-129034

(51) Int. Cl.

| | |
|---|---|
| ***B65H 3/52*** | (2006.01) |
| ***B65H 3/54*** | (2006.01) |
| ***B65H 1/02*** | (2006.01) |
| ***B65H 1/14*** | (2006.01) |
| ***B65H 1/12*** | (2006.01) |
| ***B65H 3/66*** | (2006.01) |
| ***B65H 3/06*** | (2006.01) |
| ***B65H 3/56*** | (2006.01) |
| ***B65H 5/06*** | (2006.01) |

(52) U.S. Cl.

CPC ..... *B65H 3/54* (2013.01); *B65H 1/022* (2013.01); *B65H 1/025* (2013.01); *B65H 1/12* (2013.01); *B65H 1/14* (2013.01); *B65H 3/063* (2013.01); *B65H 3/0653* (2013.01); *B65H 3/5276* (2013.01); *B65H 3/565* (2013.01); *B65H 3/66* (2013.01); *B65H 5/06* (2013.01); *B65H 2404/65* (2013.01); *B65H 2404/7412* (2013.01); *B65H 2404/7414* (2013.01); *B65H 2405/3312* (2013.01); *B65H 2513/412* (2013.01)

(58) Field of Classification Search

CPC ..... B65H 1/02; B65H 1/022; B65H 1/025; B65H 1/06; B65H 1/10; B65H 1/12; B65H 1/14; B65H 3/06; B65H 3/063; B65H 3/0653; B65H 3/34; B65H 3/46; B65H 3/5276; B65H 3/54; B65H 3/56; B65H 3/565; B65H 3/66; B65H 2404/65; B65H 2404/7412; B65H 2404/7414; B65H 2405/3312

See application file for complete search history.

(56) References Cited

U.S. PATENT DOCUMENTS 8,894,062 B1 * 11/2014 Chen ..... B65H 1/14 271/121
2005/0035531 A1 * 2/2005 Sasaki ..... B65H 1/12 271/126

(Continued)

FOREIGN PATENT DOCUMENTS

JP 2014-047050 3/2014

*Primary Examiner* — Prasad V Gokhale
(74) *Attorney, Agent, or Firm* — Workman Nydegger

(57) ABSTRACT

A feeder includes a pressing section that presses a medium after a feeding force is applied on the medium in a direction in which a leading edge of the medium set in a setting section in a feeding direction abuts on an abutment section during feeding of the media by a feed roller.

9 Claims, 17 Drawing Sheets

(56) References Cited

U.S. PATENT DOCUMENTS

| | | | | |
|---|---|---|---|---|
| 2008/0203652 | A1* | 8/2008 | Yasukawa | B65H 3/063 271/117 |
| 2014/0061998 | A1 | 3/2014 | Kasashima et al. | |
| 2014/0374986 | A1* | 12/2014 | Takada | G07D 11/0018 271/162 |
| 2015/0266690 | A1* | 9/2015 | Kajiki | B65H 3/62 358/498 |

* cited by examiner

FEEDER, IMAGE READING APPARATUS AND RECORDING APPARATUS

BACKGROUND

1. Technical Field

The present invention relates to feeders, image reading apparatuses and recording apparatuses.

2. Related Art

Feeders that have been used are configured to have a plurality of single sheets of media set in a stacked state, and include a feed roller that can feed the media set in the feeder. For example, JP-A-2014-47050 discloses a feeding apparatus (feeder) which is configured to have a plurality of single sheets of paper sheets (media) set in a stacked state, and includes a sheet feeding roller (feed roller) that can feed the paper sheets set in the feeding apparatus.

In the feeder which is configured to have a plurality of single sheets of media set in a stacked state, the feed roller rotates when a single sheet of medium is fed (separated) from a plurality of stacked media with the medium being pressed against the feed roller. However, in the conventional feeder such as the sheet feeding apparatus disclosed in JP-A-2014-47050, a space may be created ahead of the leading edge of the medium in the feeding direction depending on the timing of pressing the medium against the feed roller during feeding of the media. This may cause flexure of the medium in that space, leading to risk of jams.

SUMMARY

An advantage of some aspects of the invention is prevention of media jams during feeding.

In a first aspect of the invention, a feeder includes: a setting section in which a plurality of media is set in a stacked state; a feed roller that feeds the medium set in the setting section in a feeding direction; an abutment section on which a leading edge of the medium set in the setting section in a feeding direction abuts; and a pressing section that is configured to press the medium set in the setting section against the feed roller to apply a force in a stacking direction of the medium, wherein the pressing section is configured to press the medium after a feeding force is applied on the medium in a direction that allows the leading edge to abut on the abutment section during feeding of the media by the feed roller.

According to this aspect, the pressing section is configured to press the medium after a feeding force is applied on the medium in a direction in which the leading edge abuts on the abutment section during feeding of the media by a feed roller. With this configuration, a space can be prevented from being created on the leading side of the medium in the feeding direction. Therefore, occurrence of jams during feeding of the media can be reduced.

In a second aspect of the invention according to the first aspect, the feeder further includes a support section that supports the medium set in the setting section and moves to allow the medium to be in contact with the feed roller during feeding of the media by the feed roller.

According to this aspect, the support section that supports the medium set in the setting section and moves to allow the medium to be in contact with the feed roller during feeding of the media by the feed roller is provided. Accordingly, the medium can be in contact with the feed roller while the medium is fed, and the medium can be separated from the feed roller while the medium is not fed. Since the medium can be separated from the feed roller, the feed roller can be rotated while the medium is not fed. Accordingly, the motor that drives the feed roller can also be used as a drive motor for other components in a simple manner.

In a third aspect of the invention according to the second aspect, a driving source that rotates the feed roller and a driving source that moves the support section are different.

According to this aspect, the driving source that rotates the feed roller and the driving source that moves the support section are different. Accordingly, the rotation of the feed roller and the movement of the support section can be independently performed.

In a fourth aspect of the invention according to the third aspect, the feeder further includes a transportation roller that transports the medium which is fed by the feed roller, wherein the driving source that moves the support section also serves as the driving source that rotates the transportation roller.

According to this aspect, the driving source that moves the support section also serves as the driving source that rotates the transportation roller. As a result, the medium can be transported without providing a separate driving source rotates the transportation roller.

In a fifth aspect of the invention according to any one of the second to fourth aspects, the feed roller is driven before the support section moves during feeding of the media by the feed roller.

According to this aspect, the feed roller is driven before the support section moves during feeding of the media by the feed roller. There may be a case where a certain time is required until the rotation speed of the feed roller reaches a predetermined speed. In that case, the feed roller can be driven before the support section moves so that the medium can be pressed while the rotation speed of the feed roller has been increased. Accordingly, a space can be effectively prevented from being created on the leading side of the medium in the feeding direction. Therefore, occurrence of jams during feeding of the medium can be effectively reduced.

In a sixth aspect of the present invention according to any one of the second to fifth aspects, a movement speed of the support section is faster before the medium comes into contact with the feed roller than after the medium comes into contact with the feed roller during feeding of the media by the feed roller.

According to this aspect, a movement speed of the support section is faster before the medium comes into contact with the feed roller than after the medium comes into contact with the feed roller during feeding of the media by the feed roller. Accordingly, the medium can quickly brought into contact with the feed roller, thereby reducing the feeding time.

In a seventh aspect of the present invention according to any one of the second to sixth aspects, the abutment section is a retard roller that cooperates with the feed roller to hold and separate the medium set in the setting section.

According to this aspect, abutment section is a retard roller that cooperates with the feed roller to hold and separate the medium set in the setting section. Accordingly, a single sheet of the medium can be separated from the plurality of media which are stacked by the retard roller in an effective manner. In addition, the space can be prevented from being created on the leading side in the feeding direction of the medium, thereby reducing occurrence of jams during feeding of the media.

In an eighth aspect of the present invention according to any one of the second to sixth aspects, the abutment section is a flap that is switched between a state engaged with the support section and disengaged from the support section and configured to allow the pressing section to press the feed roller in the disengaged state, the flap assuming the disengaged state and being pressed by the medium during feeding of the media by the feed roller so as to be set back downstream in the feeding direction.

According to this aspect, the abutment section is a flap that is switched between a state engaged with the support section and disengaged from the support section and configured to allow the pressing section to press the feed roller in the disengaged state, the flap assuming the disengaged state and being pressed by the medium during feeding of the media by the feed roller so as to be set back downstream in the feeding direction. As a result, the flap can easily control whether the pressing unit presses the feed roller or not, and the space can be prevented from being created on the leading side in the feeding direction of the medium, thereby reducing occurrence of jams during feeding of the media.

In a ninth aspect of the present invention according to seventh aspect, the feeder includes a flap that is switched between a state engaged with the support section and disengaged from the support section and configured to allow the pressing section to press the feed roller in the disengaged state, the flap assuming the disengaged state and being pressed by the medium during feeding of the media by the feed roller so as to be set back downstream in the feeding direction, wherein a rotation speed of the feed roller is faster when the flap is in the state disengaged from the support section than when the flap is in the state engaged with the support section.

According to this aspect, the abutment section is a retard roller that cooperates with the feed roller to hold and separate the medium set in the setting section. Further, the feeder includes a flap that is switched between a state engaged with the support section and disengaged from the support section and configured to allow the pressing section to press the feed roller in the disengaged state, the flap assuming the disengaged state and being pressed by the medium during feeding of the media by the feed roller so as to be set back downstream in the feeding direction. The rotation speed of the feed roller is faster when the flap is in the state disengaged from the support section than when the flap is in the state engaged with the support section. As a result, since the feed roller can be rotated in high speed during the period from the time when the medium comes into contact with the feed roller until the time when the flap is set back, the space can be prevented from being created on the leading side in the feeding direction of the medium in an effective manner. Therefore, occurrence of jams during feeding of the medium can be effectively reduced.

In a tenth aspect of the present invention, an image reading apparatus includes: a reading unit that reads an image formed on the medium; and the feeder according to any one of the first to ninth aspects that feeds the medium to the reading unit.

According to this aspect, an image formed on the medium can be read while reducing occurrence of jams during feeding of the media.

In an eleventh aspect of the present invention, a recording apparatus includes: a recording unit that performs recording on the medium; and the feeder according to any one of the first to ninth aspects that feeds the medium to the recording unit.

According to this aspect, recording can be performed on the medium while reducing occurrence of jams during feeding of the media.

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to the drawings, an embodiment of the present invention will be described. However, the present invention is not limited to the embodiment described below. Various modifications are contemplated within the scope of the invention as defined in the appended claims, such modifications should be included in the scope of the present invention. In the following description, an embodiment of the present invention will be described as being included in the scope of the present invention.

Figure 1:
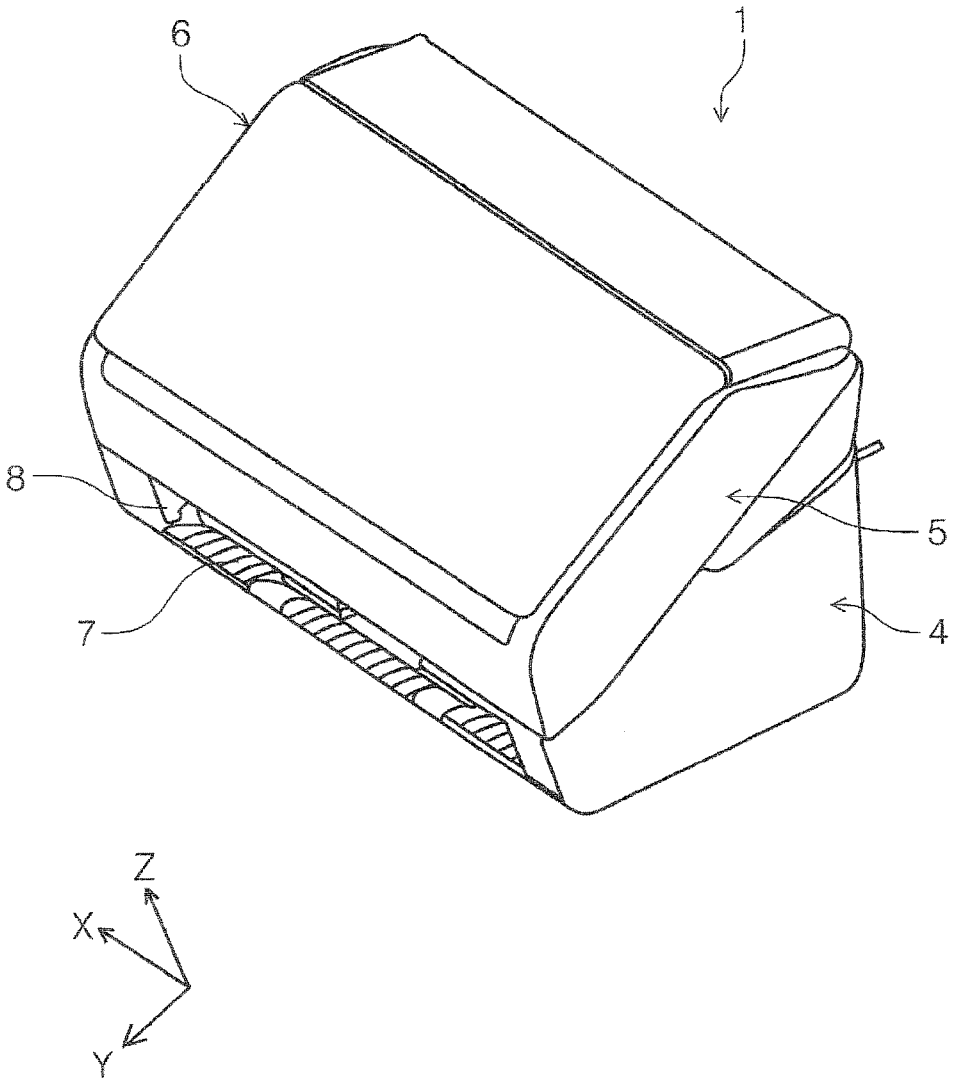
FIG. 1 is a perspective view which illustrates an outer appearance of an image reading apparatus according to the present invention.
Figure 2:
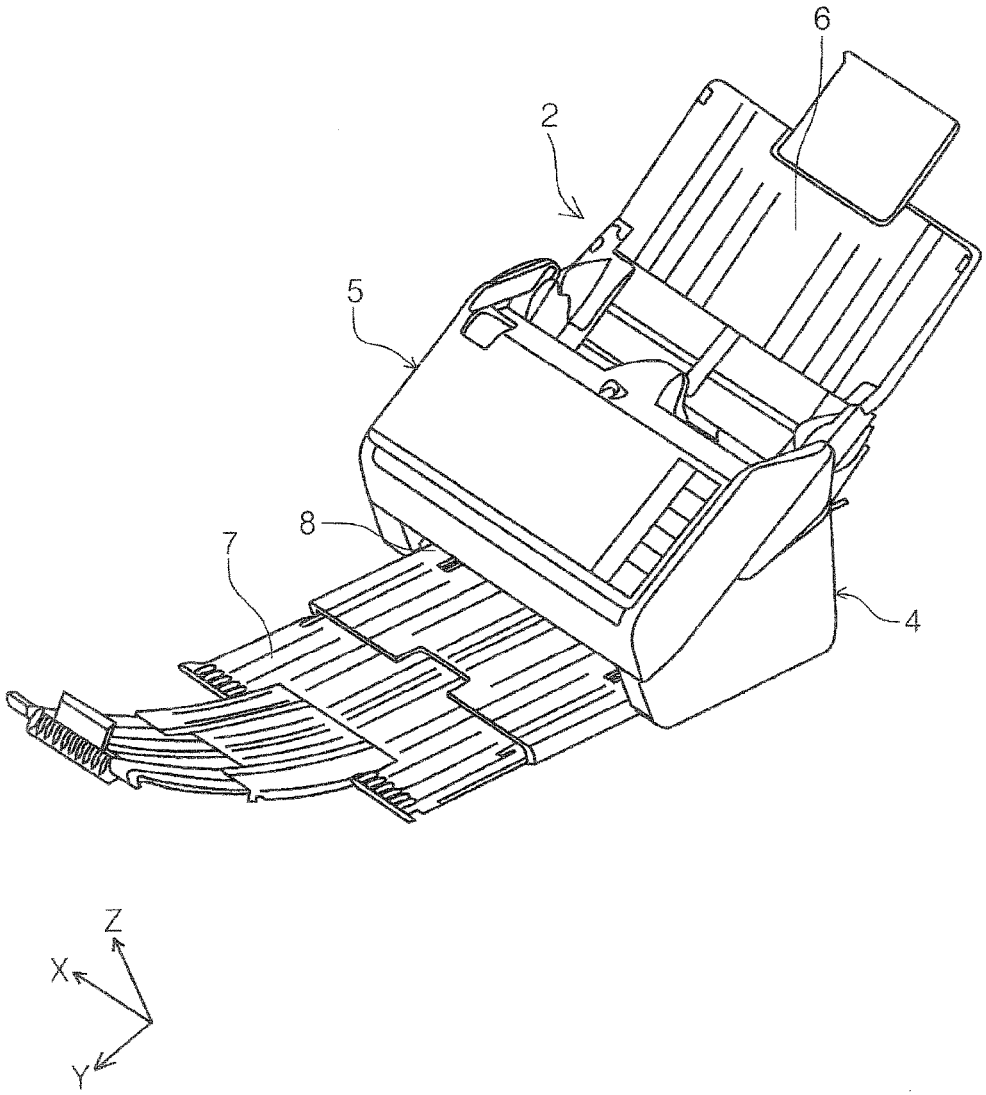
FIG. 2 is a perspective view which illustrates an outer appearance of an image reading apparatus according to the present invention with a cover thereof being open.
Figure 3:
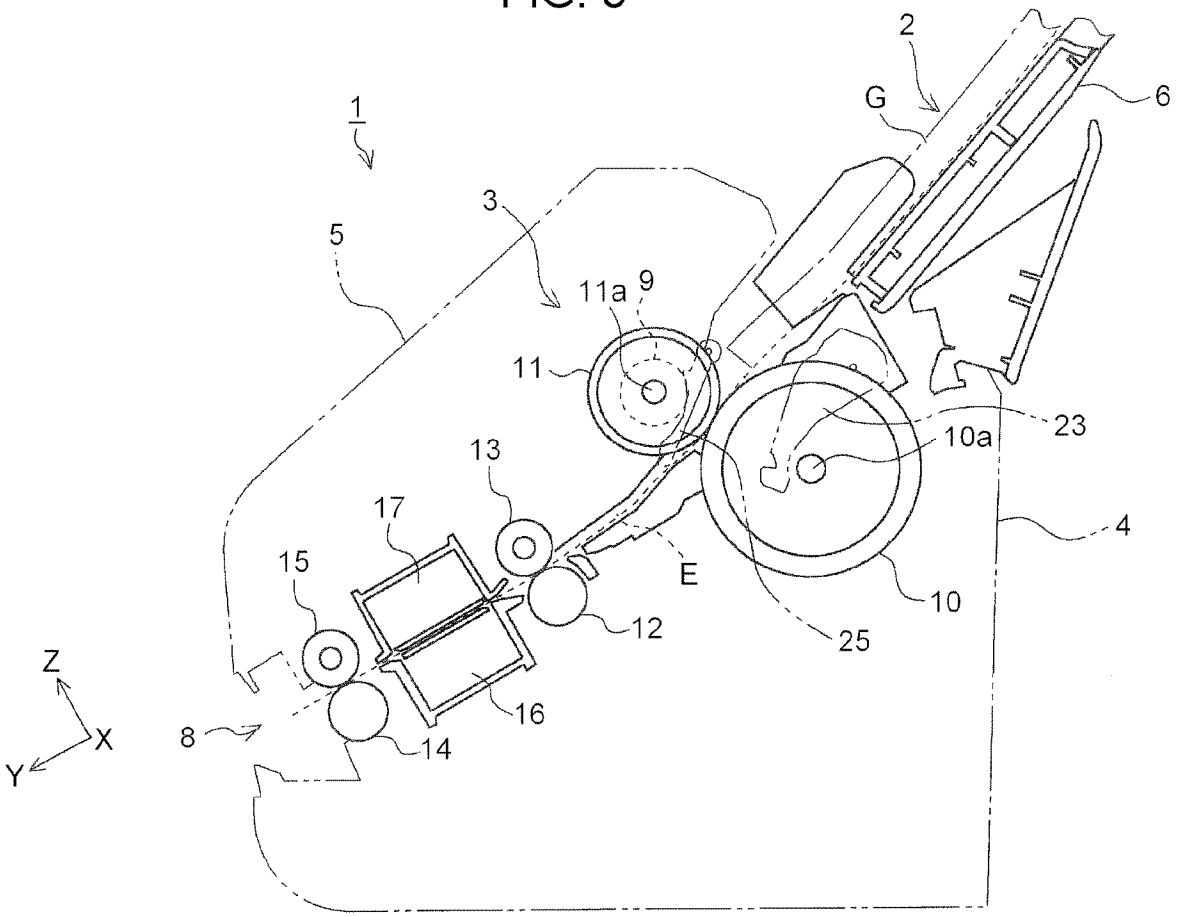
FIG. 3 is a side cross-sectional view of a medium transportation path in an image reading apparatus according to the present invention.
Figure 4:
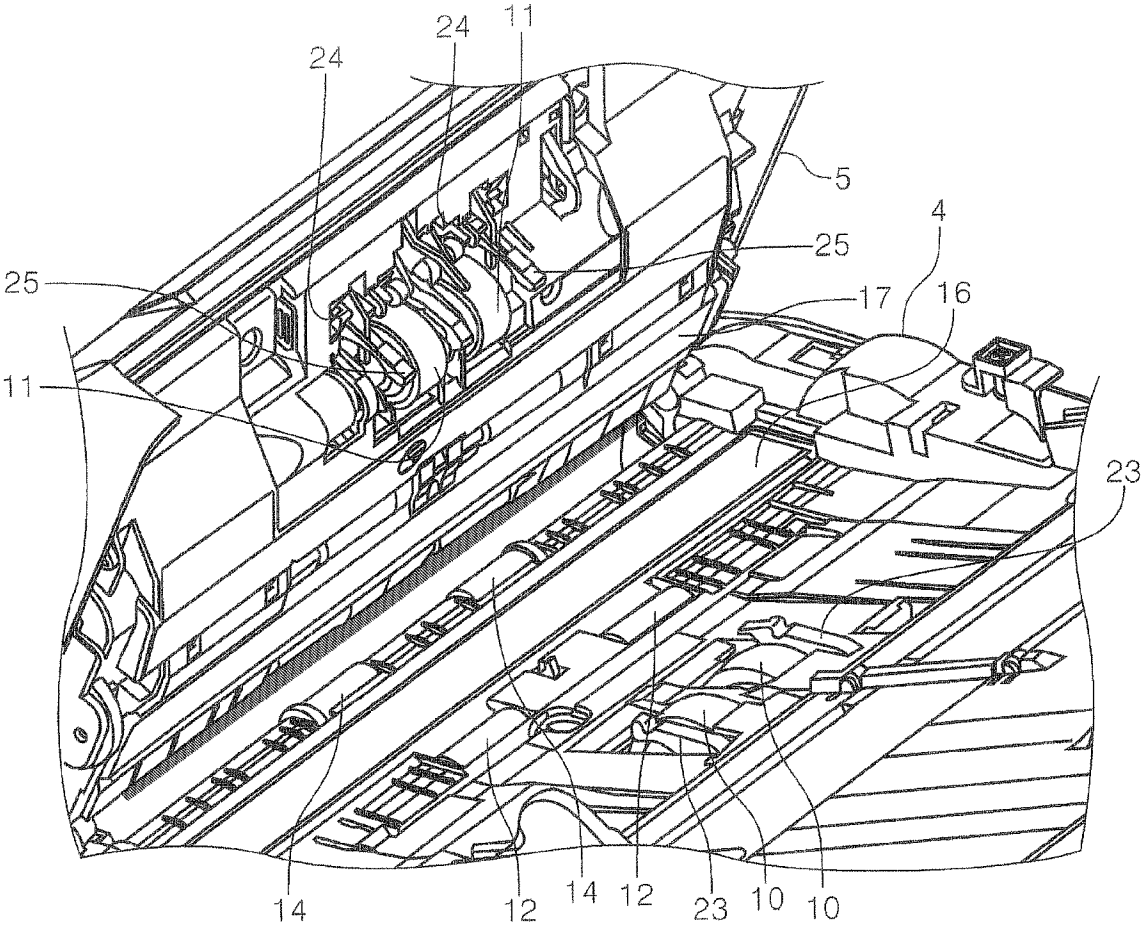
FIG. 4 is a perspective view which illustrates an image reading apparatus according to the present invention with an upper unit thereof being open.
Figure 5:
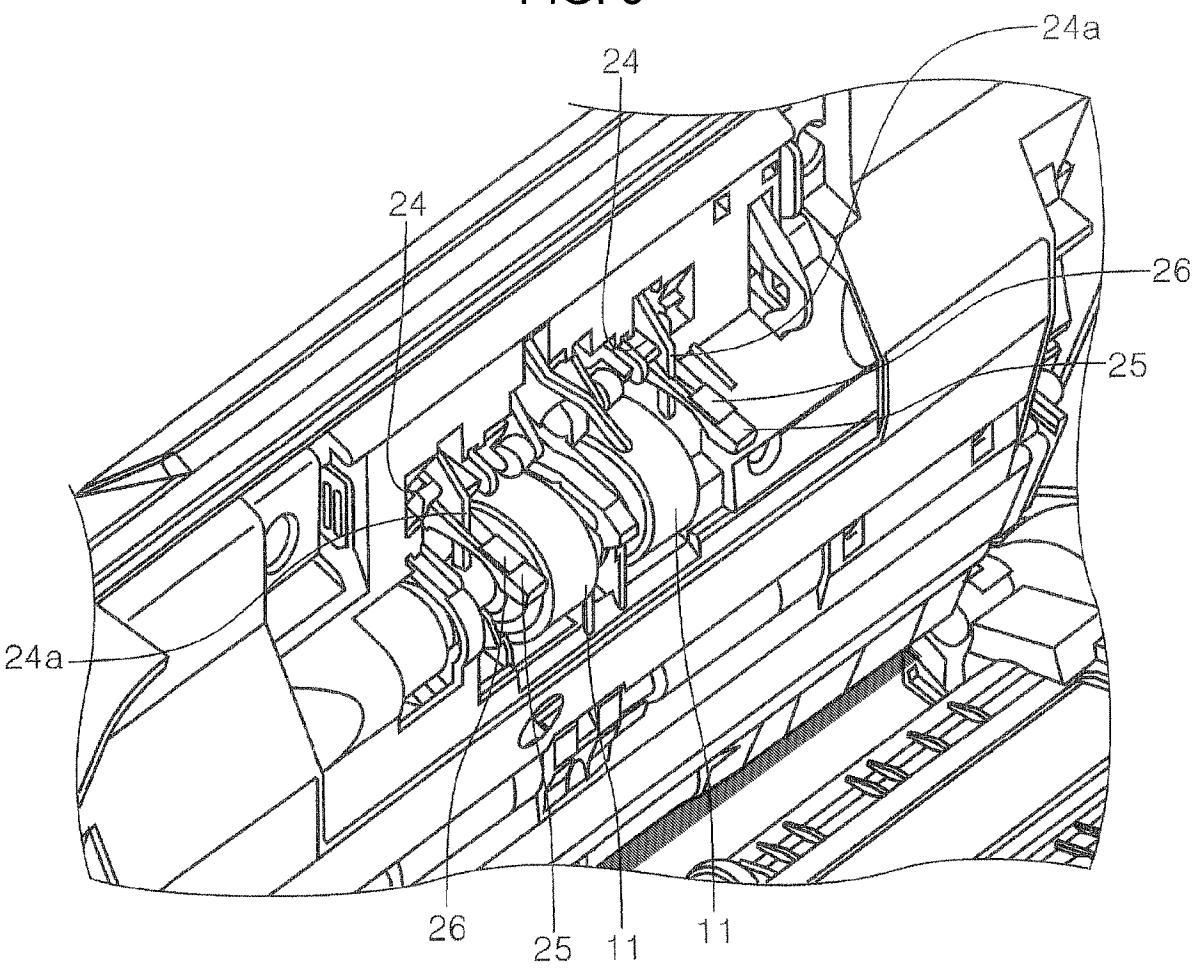
FIG. 5 is an enlarged perspective view of an essential part of an upper unit of an image reading apparatus according to the present invention.
Figure 6:
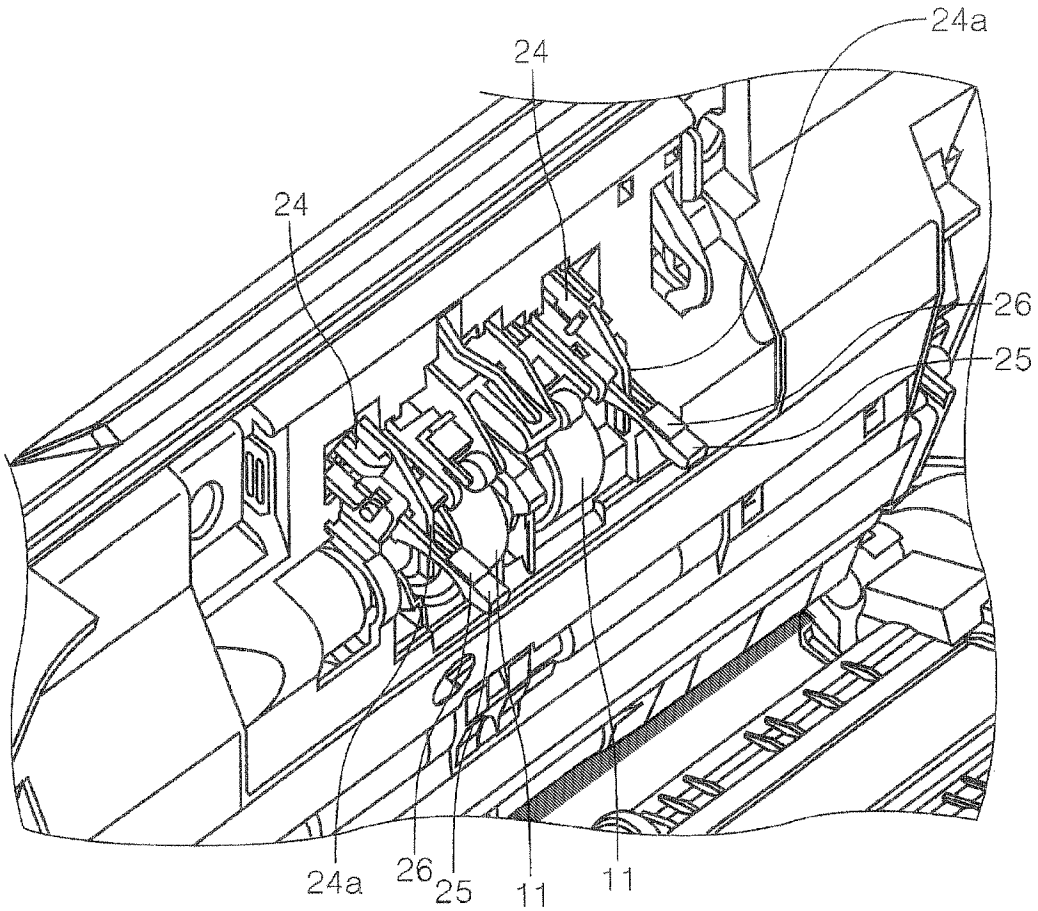
FIG. 6 is an enlarged perspective view of an essential part of an upper unit of an image reading apparatus according to the present invention.

FIG. 1 is a perspective view which illustrates an outer appearance of an image reading apparatus 1 according to an embodiment of the present invention, FIG. 2 is a perspective view which illustrates an outer appearance of the image reading apparatus 1 with a cover 6 being open, and FIG. 3 is a side cross-sectional view of a medium transportation path in the image reading apparatus 1. Further, FIG. 4 is a perspective view which illustrates the image reading apparatus 1 with the upper unit 5 being open, and FIGS. 5 and 6 are enlarged perspective views of an essential part of the upper unit 5.

In the X-Y-Z coordinate system shown in the drawings, the X direction indicates an apparatus width direction and a medium width direction, the Y direction indicates a depth direction and a medium output direction of an image reading apparatus, and the Z direction indicates a direction perpendicular to the medium output direction. Throughout the drawings, +Y direction is defined as an apparatus front side, and −Y direction is defined as an apparatus back side.

An overall configuration of the image reading apparatus 1 according to the present invention will be described. The image reading apparatus 1 is configured as a document scanner that can read at least one of a front surface and a back surface of a medium to be read. The image reading apparatus 1 includes a medium feeder 3 (FIG. 3) which is an embodiment of a feeder according to the present invention. Further, a main body of the image reading apparatus 1 includes a lower unit 4, an upper unit 5, a cover 6, and an output tray 7.

The upper unit 5 is mounted to be pivotable relative to the lower unit 4 about a rotation shaft, which is not shown, located downstream in the medium transportation direction. The upper unit 5 rotates so as to assume a closed state that configures the medium transportation path (FIGS. 1 to 3) between the lower unit 4 and the upper unit 5 and an open state that opens the medium transportation path (FIGS. 4 to 6).

The cover 6 is mounted on the upper part of the back side of the lower unit 4. The cover 6 is rotatably mounted on the lower unit 4. The cover 6 rotates so as to switch between a closed state that covers the upper part of the upper unit 5 which is shown in FIG. 1 and an open state that opens the upper part of the upper unit 5 which is shown in FIG. 2. The cover 6 constitutes part of a medium loading section (a setting section 2 on which a stack of a plurality of single sheets of media is set) in the open state.

A medium output port 8 that outputs the medium after scanning is provided on the apparatus front side. Further, the lower unit 4 includes the output tray 7 that can be pulled out from the apparatus front side through the medium output port 8. The output tray 7 can assume a state of being housed in a bottom of the lower unit 4 (see FIG. 1), and a state of being pulled out from the apparatus front side (see FIG. 2). In the present embodiment, the output tray 7 is configured by combining a plurality of tray members.

Next, referring mainly to FIG. 3, the medium transportation path in the image reading apparatus 1 will be described. In the drawings subsequent to FIG. 3, the image reading apparatus 1 and only main components of the medium feeder 3 are illustrated, and components which are unnecessary for description are omitted in illustration. Further, in FIG. 3, the lower unit 4 and the upper unit 5 are illustrated only by an outline of the housing, which is indicated by the virtual line. In the media loaded on the cover 6 in the open state, the lowermost medium (sheet) is fed downstream in the feed direction by a feed roller 10 rotated by a motor which is a driving source, which is not shown in the figure. The outer peripheral surfaces of the feed roller 10 is made of a high friction material (for example, elastomer such as rubber). The reference number 10*a* indicates the rotation shaft of the feed roller 10.

Moreover, the reference character G in FIG. 3 indicates a bundle of media loaded (set) on the cover 6. The leading edge of the bundle of media G is held by a flap 25, which is an abutment section described later, at a feeding standby position (the position shown in FIG. 3) before the start of feeding so as not to enter between the feed roller 10 and the retard roller 11, which is a separation section and an abutment section described later. The flap 25 is provided on a pressing unit 24, which is a pressing section described later.

A set guide 23 which is a support section is disposed around the feed roller 10. The bundle of media G is supported from the underside by the set guide 23 before the start of feeding so as to be separated from the feed roller 10. That is, the media G is prevented from being in contact with the feed roller 10.

Once the feeding of the media starts, the set guide 23 is set back downward so that the lowermost medium of the bundle of media G comes into contact with the feed roller 10 and the flap 25 becomes a state ready to pivot (a state ready to change the position). Accordingly, as the feed roller 10 rotates, the lowermost medium is fed in the downstream direction. The flap 25 pivots in the downstream direction by the medium fed in the downstream direction, and assumes a position that opens the medium feeding path.

A retard roller 11 is disposed at a position opposed to the feed roller 10. In the present embodiment, the retard roller 11 is biased toward the feed roller 10 by a biasing unit, which is not shown in the figure. The outer peripheral surface of the retard roller 11 is made of a high friction material (for example, elastomer such as rubber) as with the feed roller 10. The reference number 11*a* indicates the rotation shaft of the retard roller 11.

Further, the retard roller 11 includes a torque limiter 9 and is configured to be subject to a driving torque from a torque imparting section or a driving source such as a motor, which is not shown, via the torque limiter 9 in a direction opposite to a rotation direction (counter-clockwise direction in FIG. 3) in which the medium is fed downstream (clockwise direction in FIG. 3).

In the above configuration, when being in direct contact with the feed roller 10, the retard roller 11 is driven to rotate (clockwise direction in FIG. 3) by the feed roller 10 since a rotation torque from the feed roller 10 exceeds a limit torque of the torque limiter 9.

When the feeding of the media starts and a plurality of sheets of the media enter between the feed roller 10 and the retard roller 11, the retard roller 11 is not subject to the rotation torque from the feed roller 10 and stops to rotate by being driven by the feed roller 10. As a result, the media at upper positions relative to the lowermost medium which is to be fed (the medium that should not be double-fed) is not subject to a feeding force that feeds the media in the downstream direction. Accordingly, the leading edge of the media is held while abutting the retard roller 11 so as not to be advanced in the downstream. Thus, double-feeding of the media is prevented. On the other hand, the lowermost medium to be fed, which is in direct contact with the feed roller 10, is advanced in the downstream direction by a feeding force applied from the feed roller 10. The dotted line indicated by the reference character E in FIG. 3 represents a transportation trajectory of the medium transported.

As shown in FIG. 4, the feed roller 10 and the retard roller 11 of the present embodiment are disposed in the center area of the medium in the medium width direction (X direction). In the present embodiment, a feed reference position in the medium width direction (X direction) is the center. When the medium is fed as described above, the center portion of the medium in the medium width direction is brought into contact with the feed roller 10 and the retard roller 11 regardless of the size of the medium. Further, in the present embodiment, a plurality of sets (more specifically, two sets) of the feed roller 10 and the retard roller 11 are disposed in the medium width direction (X direction).

Moreover, a medium transportation unit which includes transportation rollers 12 and 13 is disposed downstream relative to the feed roller 10 and the retard roller 11. The lowermost medium, which is fed out by the feed roller 10, is further transported downstream by a feeding force applied by the transportation rollers 12 and 13.

Reading units 16 and 17 are disposed at positions downstream relative to the transportation roller 12 and 13 so as to be opposed to each other at upper and lower positions. In the present embodiment, the reading units 16 and 17 are configured, for example, as a contact image sensor module (CISM).

After at least one of the front surface and the back surface of the medium is read by the reading unit 16 and 17, the medium is outputted from the medium output port 8 by a medium discharge unit which includes transportation rollers 14 and 15 located at positions downstream relative to the reading units 16 and 17 in the transportation direction. Further, a plurality of sets (more specifically, two sets) of the transportation rollers 12 and 13, and a plurality of sets (more specifically, two sets) of the transportation rollers 14 and 15 are also disposed in the medium width direction (X direction). Among the transportation rollers 12, 13, 14 and 15, the transportation rollers 12 and 14 are driving rollers having the second motor 32 (see FIG. 8) as a driving source, and the transportation rollers 13 and 15 are driven rollers which are rotated by rotation of the transportation rollers 12 and 14.

Figure 7:
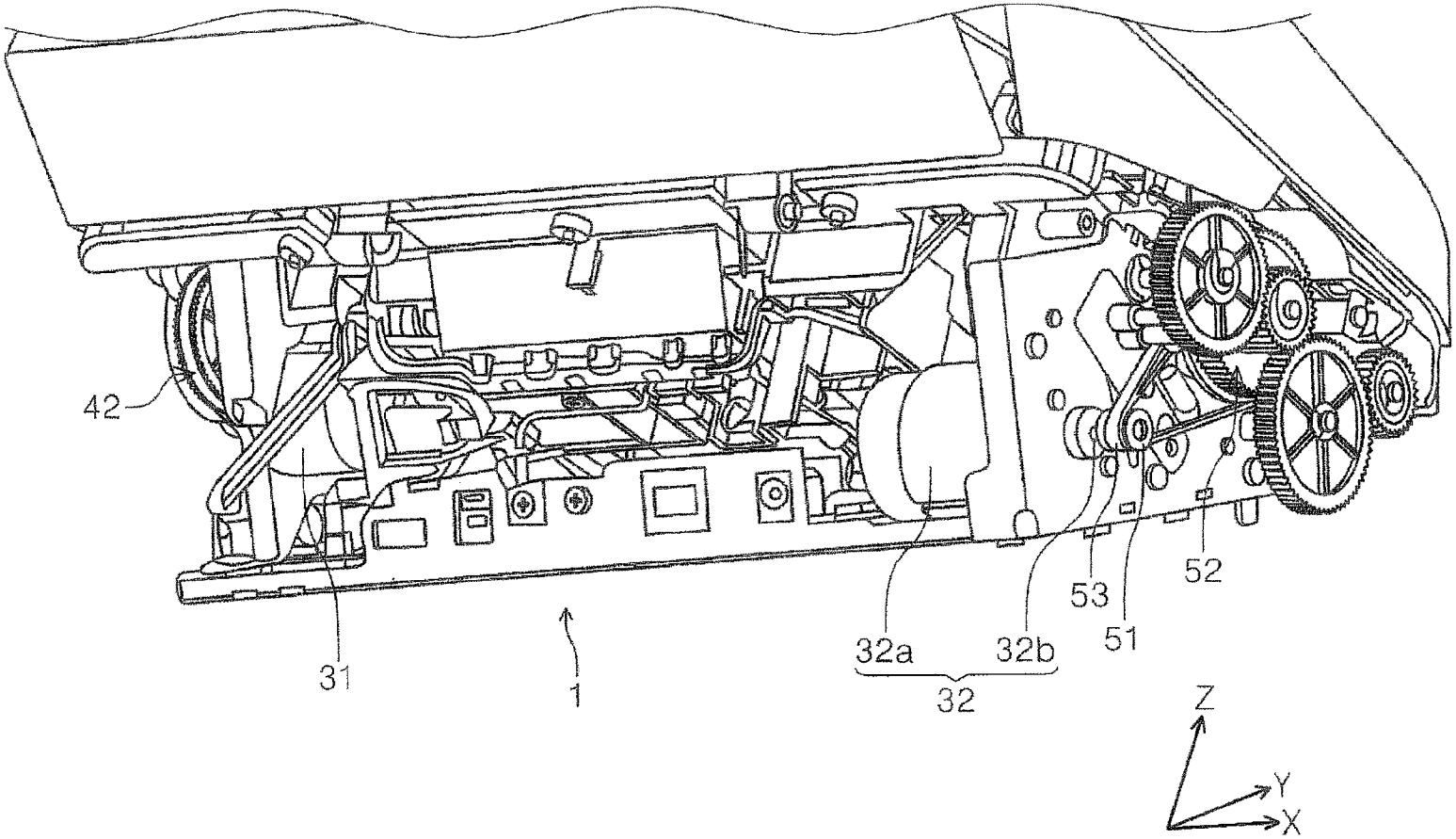
FIG. 7 is a back perspective view which illustrates an inside of an image reading apparatus according to the present invention.
Figure 8:
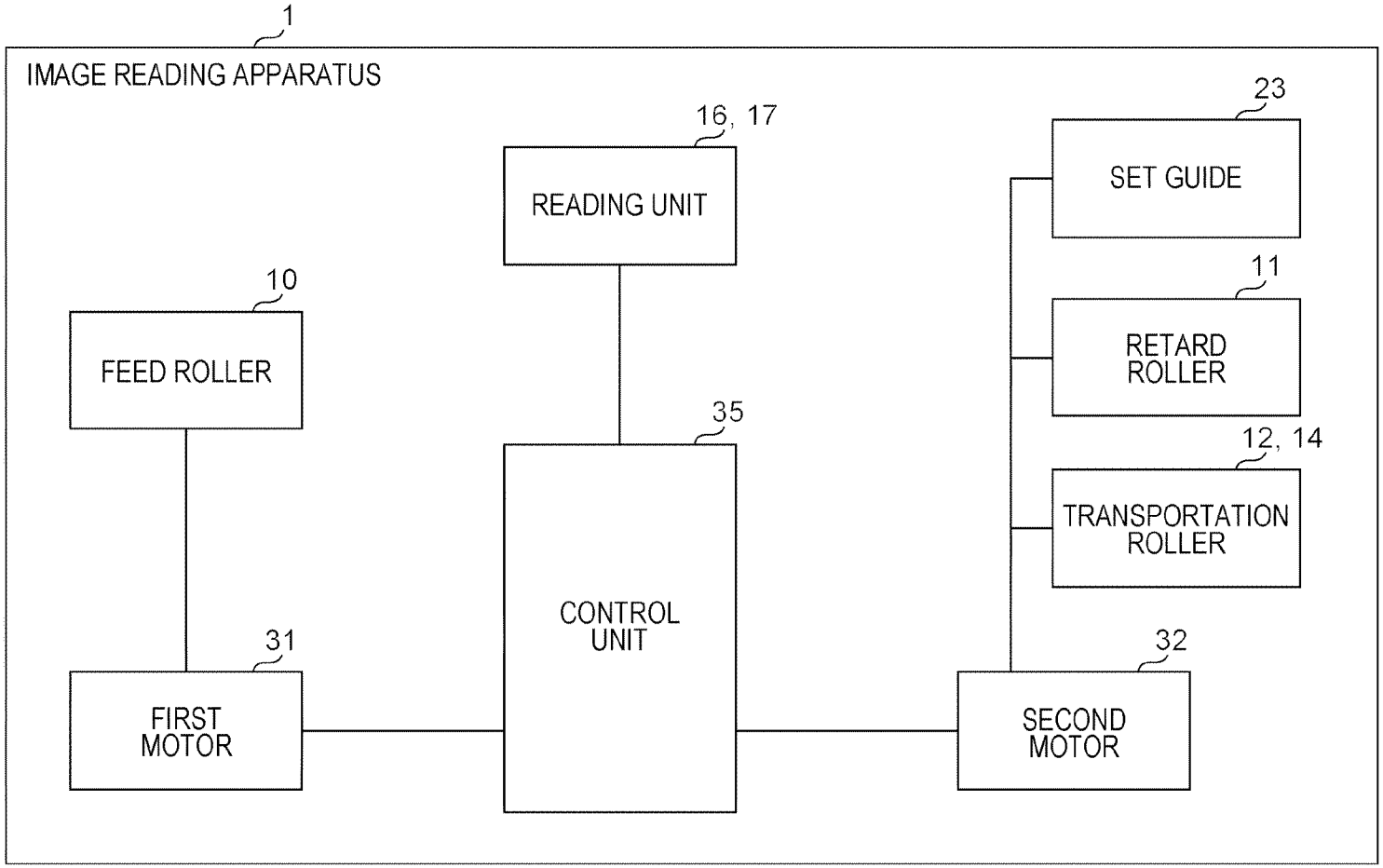
FIG. 8 is a block diagram of an image reading apparatus according to the present invention.

Next, a driving mechanism of the image reading apparatus 1 will be described. FIG. 7 is a back perspective view which illustrates an inside of the image reading apparatus 1, and FIG. 8 is a block diagram of the image reading apparatus 1. First, the driving mechanism of the feed roller 10 driven by the first motor 31 will be described. In the present embodiment, the first motor 31, which is a driving source of the feed roller 10, is a DC motor. As shown in FIG. 7, the first motor 31 is fixed to a side frame disposed on the right side (−X side) as viewed from the apparatus front side. The first motor 31 is connected to a transmission gear train 42 that transmits a power of the motor to the feed roller 10.

Next, the driving mechanism of the second motor 32 will be described. In this embodiment, the second motor 32 is a driving source of the transportation rollers 12 and 14. As shown in FIG. 8, the second motor 32 serves as a driving source for moving the set guide 23 and a driving source for rotating the retard roller 11. The second motor 32 is a DC motor as with the first motor 31, and is made up of a motor main body 32*a* and a motor output shaft 32*b* which extends from the motor main body 32*a* as shown in FIG. 7. The second motor 32 is provided with the motor main body 32*a* fixed to a side frame which is disposed on the left side (+X side) as viewed from the apparatus front side. The motor output shaft 32*b* of the second motor 32 is connected to a transmission gear train 51 that transmits a power of the motor. The motor output shaft 32*b* is further connected to the transportation rollers 12 and 14 via the timing belt 53 and the transmission gear train 52.

As shown in FIG. 8, in the image reading apparatus 1 of the present embodiment, the first motor 31 which is a driving source of the feed roller 10, the transportation rollers 12 and 14, the set guide 23, the second motor 32 which is a driving source of the retard roller 11, the reading units 16 and 17, and the control unit 35 are electrically connected. With this configuration, the control unit 35 generally controls the image reading apparatus 1.

Figure 12:
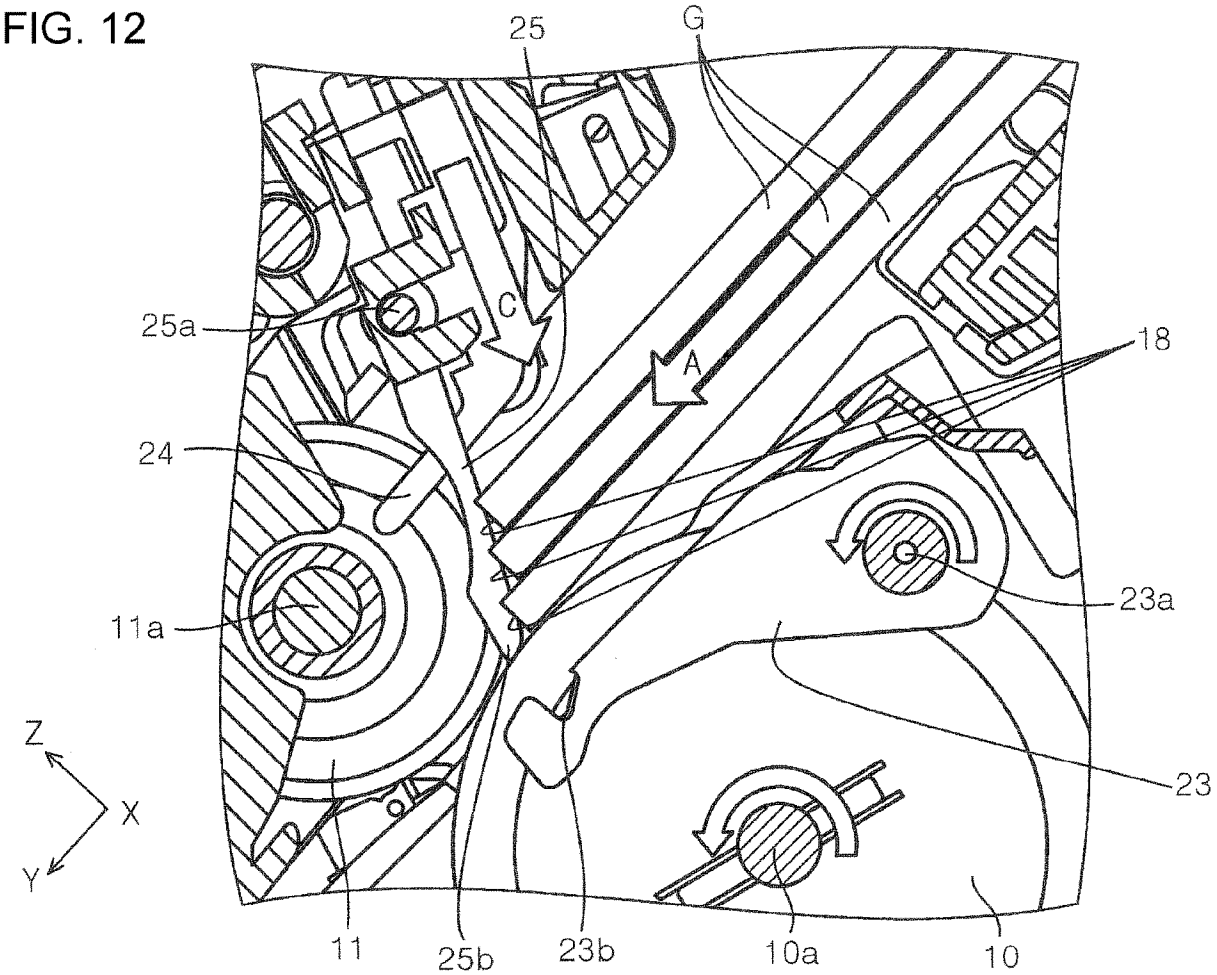
FIG. 12 is an enlarged view of a separation section that separates sheets in an image reading apparatus according to the present invention.
Figure 13:
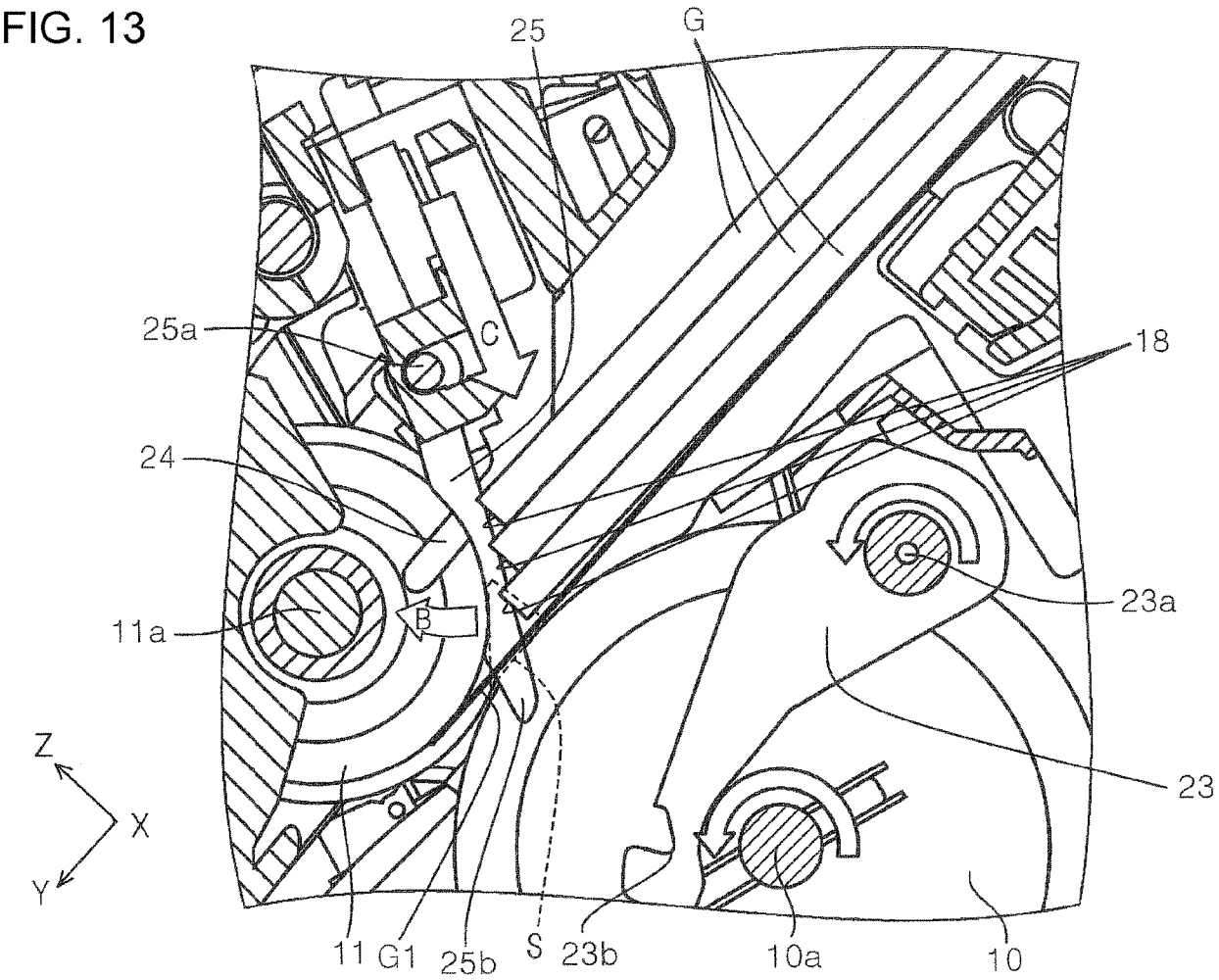
FIG. 13 is an enlarged view of a separation section that separates sheets in an image reading apparatus according to the present invention.
Figure 14:
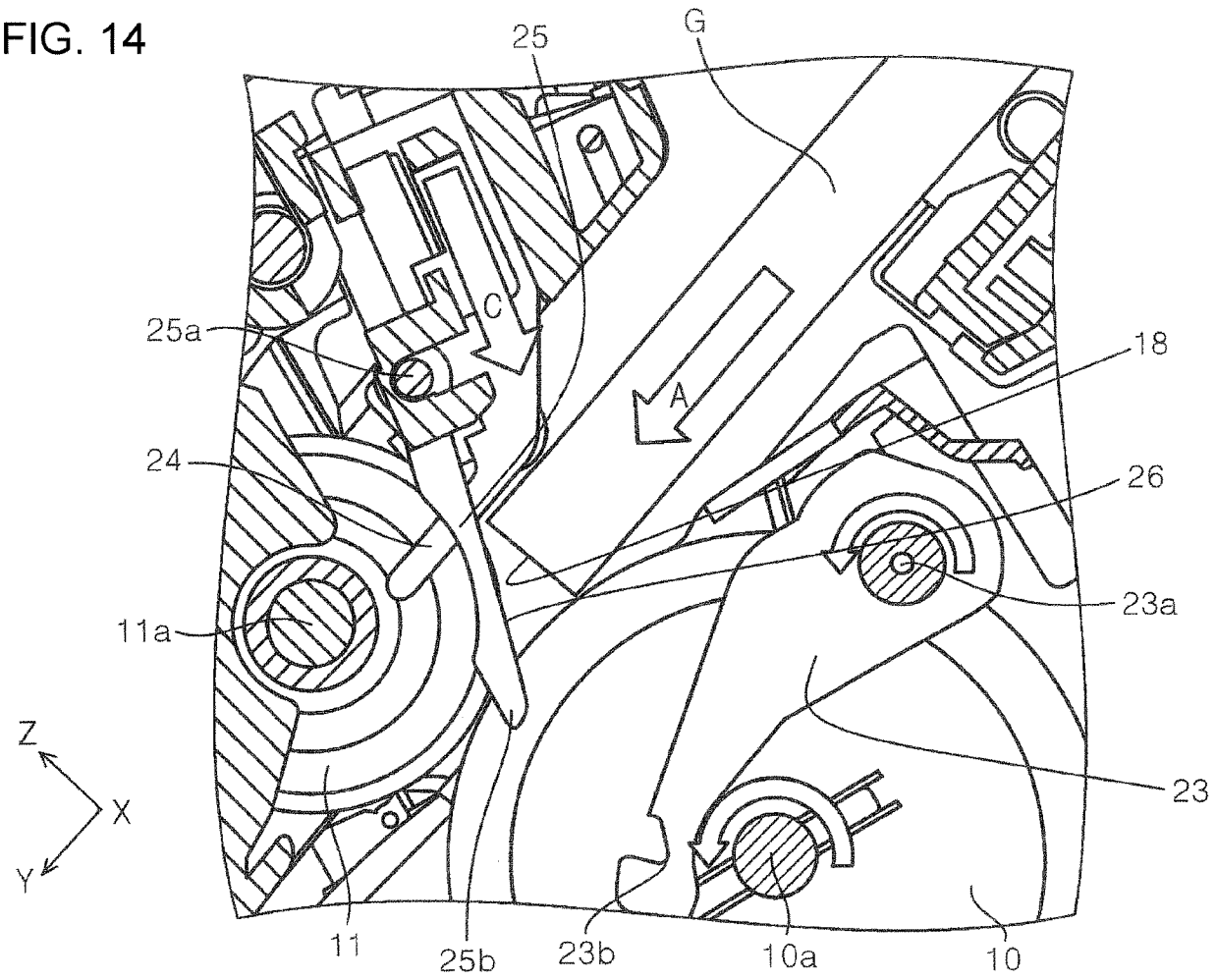
FIG. 14 is an enlarged view of a separation section that separates sheets in an image reading apparatus according to a reference example.
Figure 15:
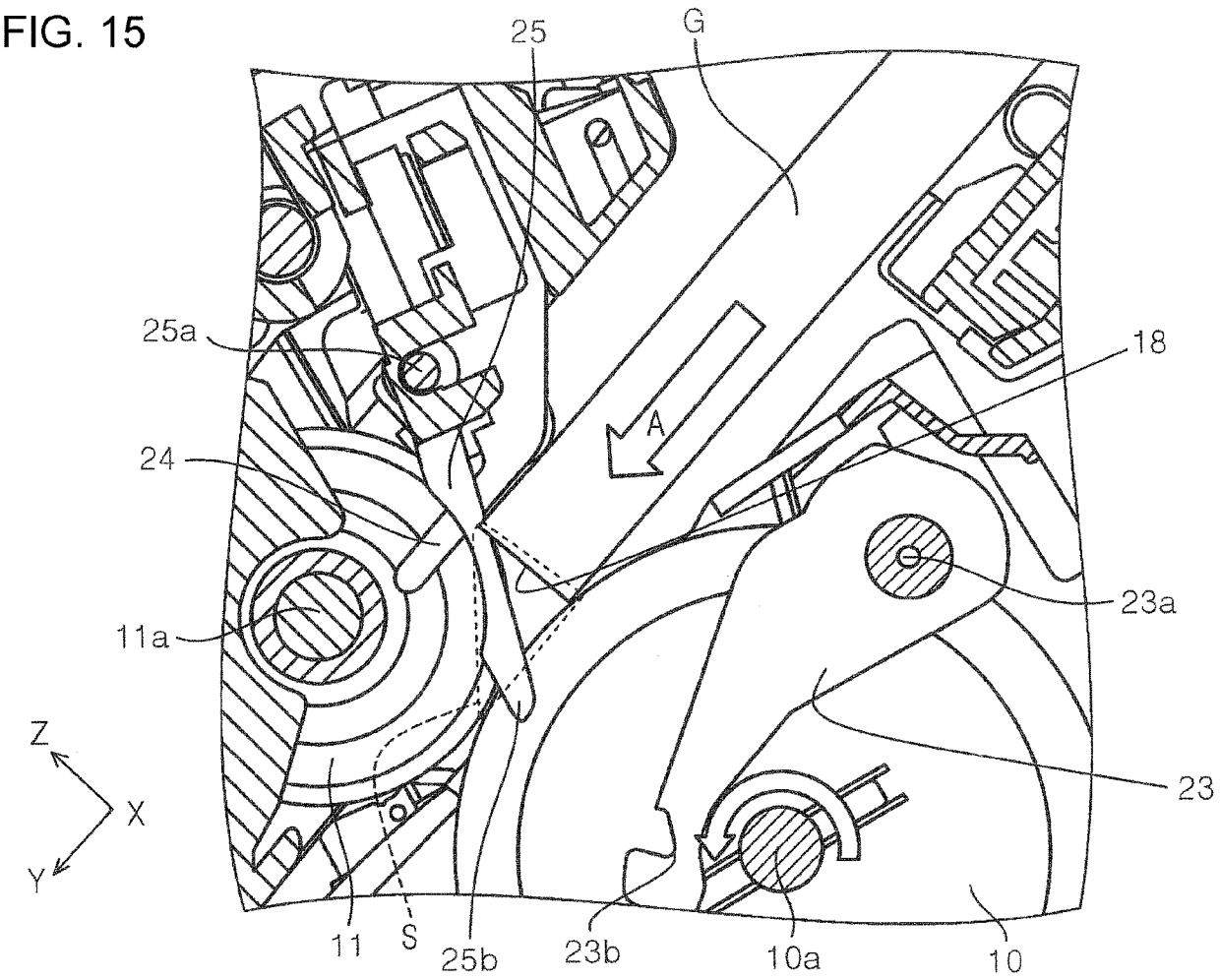
FIG. 15 is an enlarged view of a separation section that separates sheets in an image reading apparatus according to a reference example.
Figure 16:
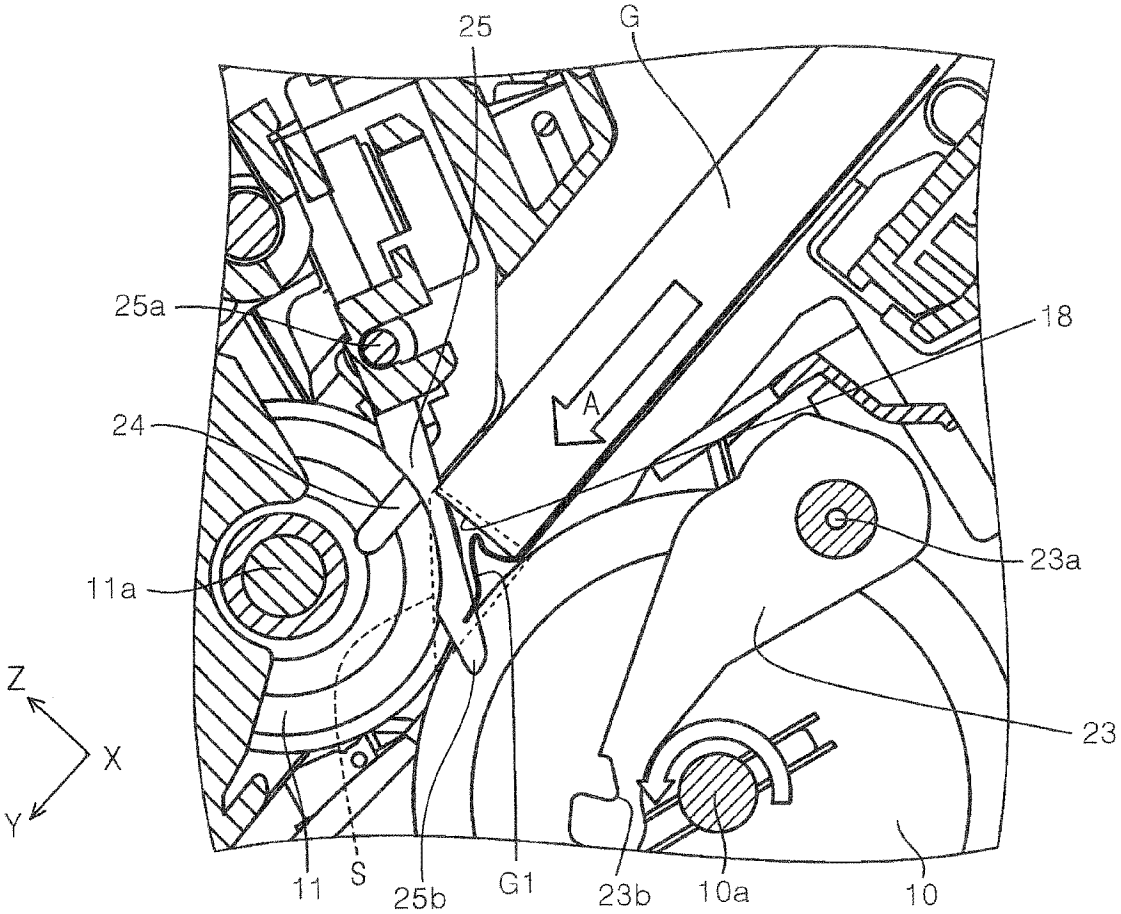
FIG. 16 is an enlarged view of a separation section that separates sheets in an image reading apparatus according to a reference example.
Figure 17:
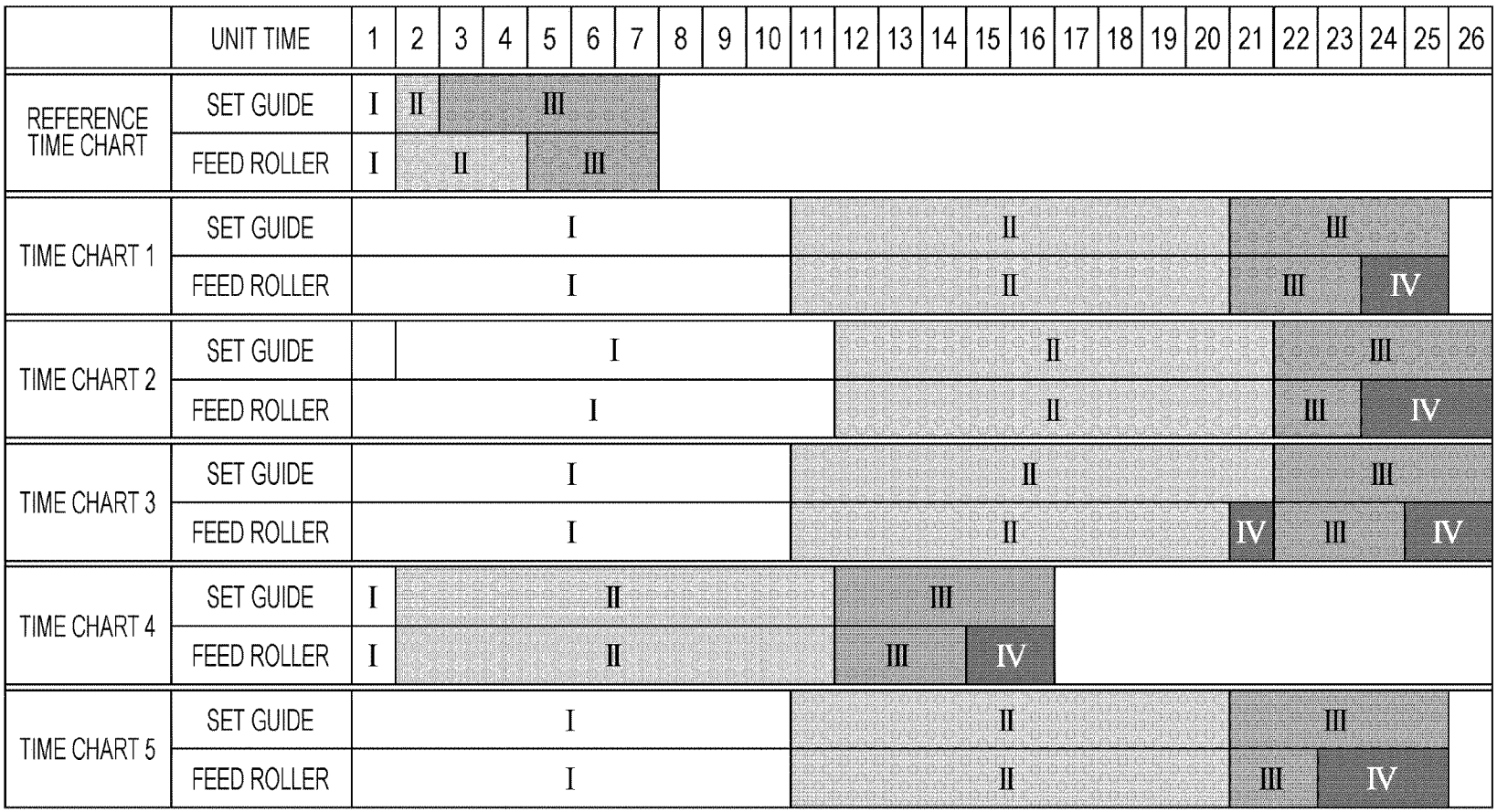
FIG. 17 is time charts during sheet separation.

With reference to FIGS. 4 to 6, and FIGS. 9 to 17, a configuration of the medium feeder 3 will be further described in detail. FIGS. 9 to 13 are enlarged views of a separation section that separates sheets in the image reading apparatus 1 according to the present embodiment, and illustrate that the set guide 23 moves downward (pivots) about a pivot shaft 23*a* as the separation proceeds from FIG. 9 to FIG. 13. FIGS. 14 to 16 are enlarged views of a separation section that separates sheets in an image reading apparatus of a reference example, and illustrate that the set guide 23 moves downward (pivots) about the pivot shaft 23*a* from the state shown in FIG. 10. The medium, the feed roller 10, the set guide 23, the pressing unit 24 and the flap 25 are moving in the arrow direction in the figure. FIG. 17 is time charts during sheet separation. Specifically, the state of the set guide 23 and the feed roller 10 (states I to IV, which is described later) of the image reading apparatus 1 is shown by unit time which corresponds to a predetermined clock number of the clock signal that drives the image reading apparatus 1.

As described above, the medium feeder 3 includes the pressing unit 24 and the set guide 23. The pressing unit 24 is provided so as to be advanced and withdrawn relative to the feed roller 10, and is biased toward the feed roller 10 by a biasing unit, which is not shown in the figure.

Figure 9:
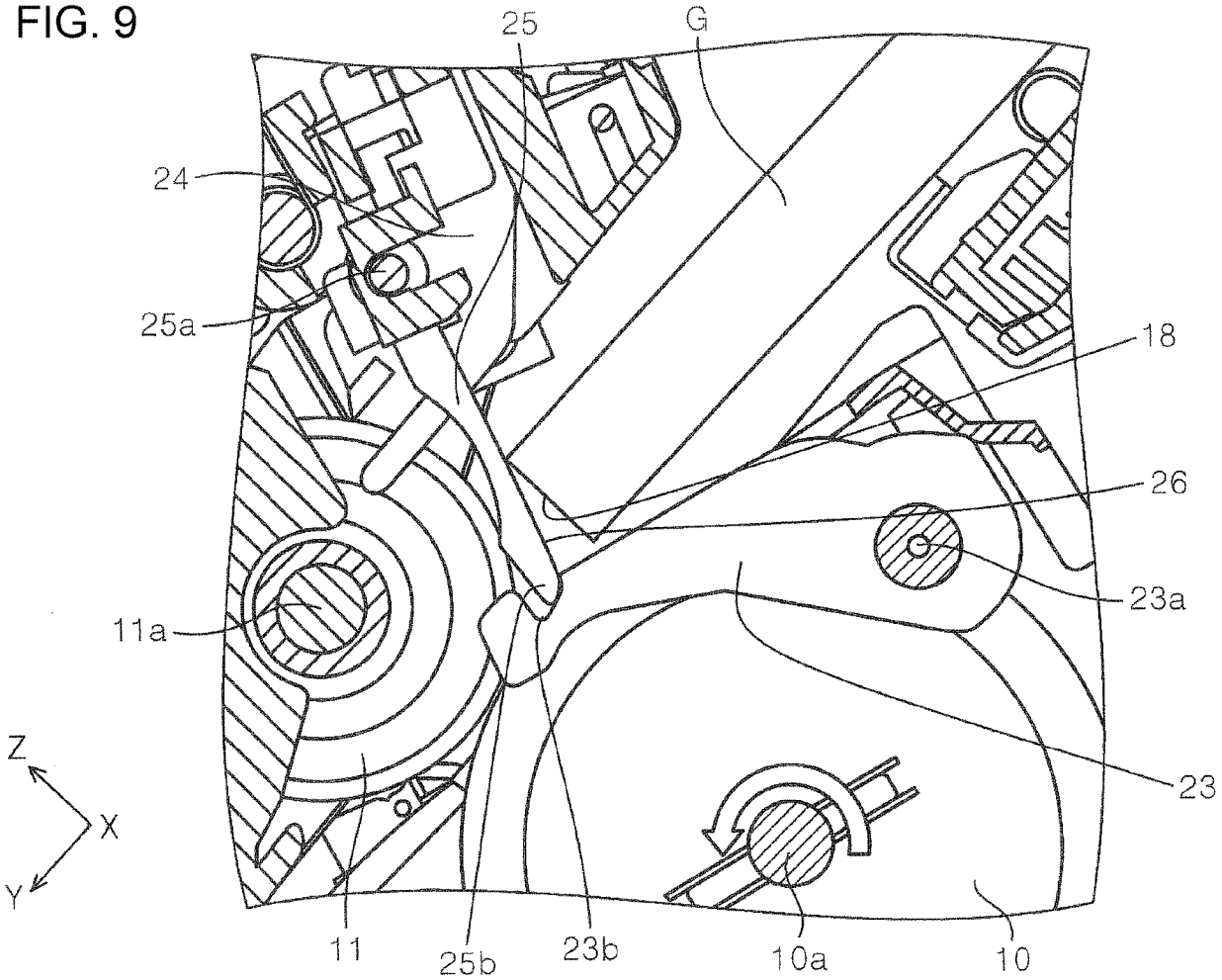
FIG. 9 is an enlarged view of a separation section that separates sheets in an image reading apparatus according to the present invention.
Figure 10:
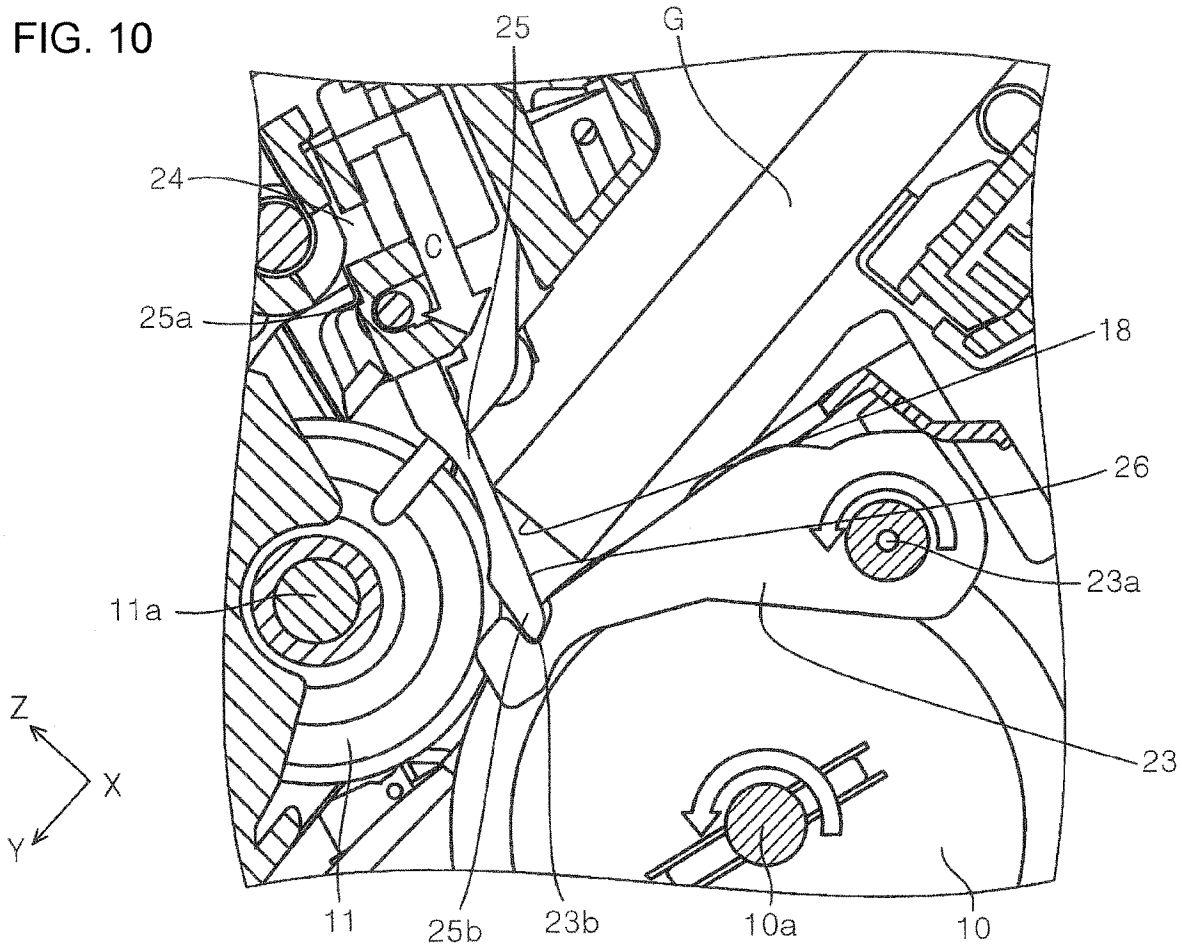
FIG. 10 is an enlarged view of a separation section that separates sheets in an image reading apparatus according to the present invention.

Moreover, the set guide 23 is provided to be pivotable about the pivot shaft 23*a*, and is configured to be movable by the second motor 32 from an advanced state in which the set guide 23 is advanced to the medium feed path (toward the pressing unit 24) (state from FIG. 9 to FIG. 10) to a setback state in which the set guide 23 is set back from the medium feed path (state from FIG. 10 to FIG. 13). The set guide 23 in the advanced state supports the bundle of media G set as described above, thereby preventing the lowermost medium from coming into contact with the feed roller 10. The state shown in FIG. 10 is an instant when the advanced state shifts to the setback state, and the lowermost medium is in contact with both the set guide 23 and the feed roller 10.

Further, a recess 23*b* which is an engagement section is formed on the set guide 23. In the advanced state of the set guide 23, a distal end 25*b* of the flap 25 enters the recess 23*b* as shown in FIGS. 9 and 10. In this state, the pressing unit 24 resists against a biasing force of a biasing unit, which is not shown, and is lifted by the set guide 23 via the flap 25 and remains to be separated from the feed roller 10. In this advanced state, the pressing unit 24 does not press the bundle of media G. Further, in the advanced state, since the distal end 25*b* of the flap 25 enters the recess 23*b* of the set guide 23, the flap 25 is regulated from rotating about the pivot shaft 23*a* and holds a blocking position that blocks the medium feeding path. That is, the pivot operation is regulated so that switching is not performed. The advanced state which is the state from FIG. 9 to FIG. 10 corresponds to the state I in FIG. 17. Specifically, the state I shows the state after the set guide 23 starts to move and the feed roller 10 starts to rotate while the lowermost medium and the feed roller 10 are located at positions not in contact with each other. Further, at the state shown in FIG. 10, the feed roller 10 has already been rotating.

FIGS. 4 and 5 show the advanced state in which the pressing unit 24 is separated from the feed roller 10 and the set guide 23 is advanced to the medium feed path. In contrast, FIG. 6 shows the setback state in which the pressing unit 24 is advanced toward the feed roller 10 and the set guide 23 is set back from the medium feed path. In addition, the flap 25 is biased by a biasing unit, not shown in the figure, toward the blocking position that blocks the medium feeding path.

Figure 11:
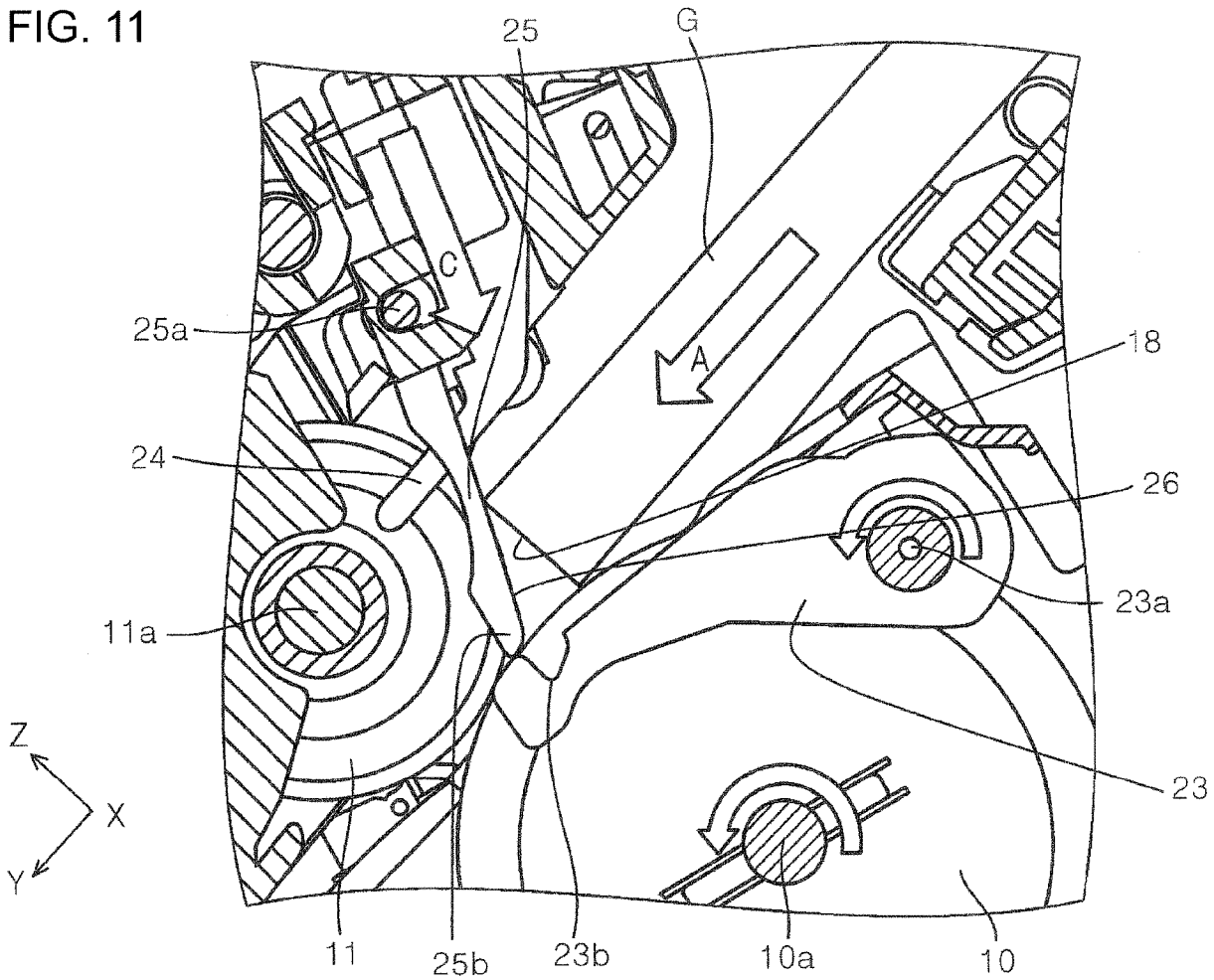
FIG. 11 is an enlarged view of a separation section that separates sheets in an image reading apparatus according to the present invention.

When the feeding of the media starts, the set guide 23 is switched from the advanced state to the setback state as shown in FIG. 11 (also, the flap 25 is switched from an engaged state to a non-engaged state) so that the lowermost medium comes into contact with the feed roller 10. Here, the medium feeder 3 of the present embodiment is configured such that the pressing unit 24 presses the bundle of media G as shown in FIG. 13 when a certain time has elapsed after the lowermost medium and the feed roller 10 are in contact with each other as shown in FIGS. 11 and 12. As a result, as shown in FIGS. 12 and 13, the leading edge 18 of the bundle of media G in the feeding direction A abuts and conforms with the flap 25 which serves as the abutment section or the retard roller 11 to thereby prevent a space S from being created (increasing in size) on the leading side in the feeding direction A. The space S refers to a space created by the surface on the leading edge of the bundle of media G in the feeding direction A, the abutment surface of the abutment section, and the roller surface of the feed roller 10 (see FIGS. 13, 15 and 16). Further, at the state shown in FIG. 11, the feed roller 10 has already been rotating. In the state in which the feed roller 10 has rotated, it is necessary to provide the state in which the lowermost medium and the feed roller 10 are in contact with each other (the state in which a feeding force is applied on the medium) and the bundle of media G is not pressed in order to reduce the size of the space S created on the leading side in the feeding direction A. This is because the leading edge 18 of the bundle of media G does not abut and conform with the abutment section by the friction force due to the gravitation force when the feed roller 10 is not rotating or when the lowermost medium and the feed roller 10 are not in contact with each other, and, the leading edge 18 of the bundle of media G does not abut and conform with the abutment section due to the friction force being too large when the bundle of media G is pressed.

The medium feeder 3 of the present embodiment includes the setting section 2 on which a stack of a plurality of single sheets of media is set, the feed roller 10 that feeds the media set in the setting section 2 in the feeding direction A which is perpendicular to the stacking direction of the media, and the abutment section on which the leading edge 18 of the media set in the setting section 2 in the feeding direction A can abut, and the pressing unit 24 that can press the media set in the setting section 2 against the feed roller 10 to thereby apply a force in the stacking direction. The pressing unit 24 is configured to press the media after a feeding force is applied on the media in the direction in which the leading edge 18 is allowed to abut the abutment section during transportation of the media by means of the feed roller 10 (that is, when the feed roller 10 is rotated to thereby allow the lowermost medium and the feed roller 10 to be in contact with each other) by the control unit 35 controlling the driving timing and the driving speed of the first motor 31 and the second motor 32. Accordingly, this configuration prevents the space S from being created on the leading side of the medium in the feeding direction A. Therefore, in this configuration, jams during feeding of the media can be reduced.

In other words, the image reading apparatus 1 of the present embodiment includes the reading units 16 and 17 that read an image formed on the medium, and the medium feeder 3 as described above that feeds the medium to the reading units 16 and 17. Therefore, the image formed on the medium can be read while jams during feeding of the media is reduced.

In addition, the configuration may also include a recording unit that performs recording on the medium instead of the reading units 16 and 17. That is, the recording apparatus which includes the recording unit that performs recording on the medium and the medium feeder 3 as described above that feeds the medium to the recording unit can be provided to perform recording on the medium while reducing jams during feeding of the media.

Further, in the state shown in FIG. 12, since the pressing unit 24 is released from a state of being pushed upward by the set guide 23 via the flap 25, the pressing unit 24 is advanced toward the feed roller 10 by a biasing force from a biasing unit, which is not shown, to thereby press the bundle of documents G toward the feed roller 10 as shown in FIG. 13. The setback state in the state shown in FIG. 10 to FIG. 11 corresponds to the state II in FIG. 17. Specifically, the state II shows the state of the set guide 23 until the flap 25 disengages from the set guide 23 and the state of the feed roller 10 when the feed roller 10 allows the bundle of media G, that is, the leading edge 18 of the bundle of media G in the feeding direction A to abut the flap 25 while the lowermost medium and the feed roller 10 are located at positions in contact with each other.

Moreover, FIGS. 12 and 13 show the state in which the flap 25 pivots in the direction B and becomes ready to be set back to thereby assume a position that opens the medium feed path by the medium fed downstream in the feeding direction A. Further, FIG. 13 shows the state in which the pressing unit 24 presses the bundle of media G in a press direction C to apply a force in the stacking direction. The state shifting from the state shown in FIG. 12 to the state shown in FIG. 13 corresponds to the state III in FIG. 17. Specifically, the state III shows the state of the set guide 23 until the first sheet of the medium is fed out after the flap 25 pivots in the direction B and becomes ready to be set back and the state until the pressing unit 24 presses the bundle of media G so that the leading edge 18 of the bundle of media G conforms with the abutment section after the flap 25 pivots in the direction B and becomes ready to be set back.

Further, FIG. 17 shows the state IV in which the feed roller 10 rotates to allow the leading edge 18 of the media in the feeding direction A to abut the abutment section (to conform the abutment section) during the period before the pressing unit 24 starts to press the bundle of media G to apply the force in the stacking direction (during the period in which the pressing unit 24 does not press the bundle of media G). Specifically, the state in which the leading edge 18 of the bundle of media G abuts the flap 25 during the period in which the pressing unit 24 does not press the bundle of media G falls within the state IV that corresponds to the unit time 21 of the time chart 3, which corresponds the difference between the state of the feed roller 10 and the state of the set guide 23 in the state II. Further, the state in which the leading edge 18 of the bundle of media G abuts the retard roller 11 during the period in which the pressing unit 24 does not press the bundle of media G is the state IV that corresponds to the unit time other than the unit time 21 of the time chart 3, which corresponds the difference between the state of the feed roller 10 and the state of the set guide 23 in the state III. Details of the time charts in FIG. 17 will be described later.

On the other hand, if the image reading apparatus according to a reference example is used, the state shown in FIGS. 14 to 16 follows the state shown in FIGS. 9 and 10. If the image reading apparatus according to a reference example is used, when the medium is fed by the feed roller 10, the pressing unit 24 presses the medium before the leading edge 18 abuts the abutment section as shown in FIG. 14. As a result, the space S formed on the leading side in the feeding direction A increases in size as shown in FIGS. 15 and 16. This results in flexure of a lowermost medium G1 in the large space S as shown in FIG. 16, leading to occurrence of jams.

A reference time chart in FIG. 17 corresponds to FIGS. 14 to 16, which corresponds to the time chart during sheet separation when the image reading apparatus according to a reference example is used. The reference time chart does not include the state that corresponds to the state IV. This corresponds to the fact that the medium is pressed before the leading edge 18 abuts the abutment section when the medium is fed by the feed roller 10. As a consequence, the space S formed on the leading side in the feeding direction A increases in size as described above, causing high occurrence of jams.

In the time chart 1 in FIG. 17, a general movement speed of the set guide 23 is slow compared with the case of the reference time chart so that the medium is pressed after the leading edge 18 abuts on the retard roller 11. In other words, the state of the set guide 23 in the state II is configured not to be shorter than the state of the feed roller 10 in the state II (the same applies to the time charts 2 to 5). In this configuration, an increase in size of the space S formed on the leading side in the feeding direction A can be prevented, thereby reducing occurrence of jams.

In the time chart 2 in FIG. 17, a general movement speed of the set guide 23 is slow compared with the case of the reference time chart, and the feed roller 10 is rotated before the set guide 23 moves (the feed roller 10 becomes the state I before the set guide 23 does). That is, the medium feeder 3 of the present embodiment can drive the feed roller before the support section moves during feeding of the media by the feed roller 10. Here, there may be a case where a certain time is required until the rotation speed of the feed roller 10 reaches a predetermined speed. In that case, the feed roller 10 can be driven before the set guide 23 moves so that the medium can be pressed while the rotation speed of the feed roller 10 has become fast. This is because that the medium can conform with the abutment section in the initial phase of the pressing by the pressing unit 24 by virtue of a fast rotation speed, and thus the period in which the medium conforms with the abutment section, which corresponds to the state IV, can be extended. Therefore, the space S can be prevented from being created on the leading side in the feeding direction A of the medium in an effective manner, thereby effectively reducing occurrence of jams during feeding of the media.

In the time chart 3 in FIG. 17, a general movement speed of the set guide 23 is slow compared with the case of the reference time chart, and the movement speed of the set guide 23 in the state II is further slow. That is, the medium feeder 3 in the present embodiment is configured to slow the movement speed of the set guide 23 in the period after the medium comes into contact with the feed roller 10 (state II) than that in the period before the medium comes into contact with the feed roller 10 (state I) during feeding of the media by the feed roller 10. As a result, the space S can be prevented from being created on the leading side in the feeding direction A of the medium in an effective manner during the period from the time when the medium comes into contact with the feed roller 10 until the time when the flap 25 is set back (unit time 21). Therefore, occurrence of jams during feeding of the media can be effectively reduced. The term "to slow the movement speed of the set guide 23" includes to temporarily stop the movement of the set guide 23.

In the time chart 4 in FIG. 17, the movement speed of the set guide 23 in the state I is the same as that of the reference time chart, and the movement speed of the set guide 23 in the state II and state III is slow. That is, the medium feeder 3 in the present embodiment is configured such that the movement speed of the set guide 23 in the period until the medium comes into contact with the feed roller 10 (state I) is faster than that in the period after the medium comes into contact with the feed roller 10 (state II and state III) during feeding of the media by the feed roller 10. Accordingly, the medium can be quickly brought into contact with the feed roller 10, thereby reducing the feeding time. In this time chart, the driving source (first motor 31) that rotates the feed roller 10 and the driving source (second motor 32) that moves the set guide 23 are not necessarily different. However, when different driving sources are used, this time chart can be executed with ease (at low cost) only by modifying the control program in the control unit 35 (the same applies to the time chart 5).

In the time chart 5 in FIG. 17, a general movement speed of the set guide 23 is slow compared with the case of the reference time chart, and the rotation speed of the feed roller 10 in the state III is fast. Here, the medium feeder 3 of the present embodiment includes the flap 25 which can be switched between the state engaged with the set guide 23 (FIGS. 9 and 10) and the state disengaged from the set guide 23 (FIGS. 12 and 13) and configured to allow the pressing unit 24 to press the feed roller 10 in the disengaged state, and the flap 25 assumes the disengaged state and is pressed by the medium during feeding of the media by the feed roller 10 so as to be set back downstream in the feeding direction. The rotation speed of the feed roller 10 can be faster when the flap 25 is in the state disengaged from the set guide 23 (state III) than when the flap 25 is in the state engaged with the set guide 23 (state I). As a result, since the feed roller 10 can be rotated in high speed during the period from the time when the medium comes into contact with the feed roller 10 until the time when the flap 25 is set back, the medium can conform to the abutment section in the initial phase of pressing, thereby extending the period in which the medium conforms to the abutment section, which corresponds to the state IV. Accordingly, the space S can be prevented from being created on the leading side in the feeding direction A of the medium in an effective manner. Therefore, occurrence of jams during feeding of the media can be effectively reduced.

Although the entire time length in each of the time charts 1 to 5 is longer than that in the reference time chart, these time charts represent the time required only for feeding the first medium during feeding of a plurality of media. In addition to that, the entire time length in each of the time charts 1 to 5 is less than 1 second. Accordingly, the user does not actually feel that the entire time length in each of the time charts 1 to 5 is longer than that in the reference time chart.

Moreover, the set guide 23 of the present embodiment is configured to support the medium set in the setting section 2, and moves the medium to come into contact with the feed roller 10 during feeding of the media by the feed roller 10. Accordingly, the medium can be in contact with the feed roller 10 while the medium is fed, and the medium can be separated from the feed roller 10 while the medium is not fed. Since the medium can be separated from the feed roller 10, the feed roller 10 can be rotated while the medium is not fed. Accordingly, the motor that drives the feed roller 10 can also be used as a drive motor for other components in a simple manner.

Moreover, the medium feeder 3 in the present embodiment uses different driving sources for the driving source (first motor 31) that rotates the feed roller 10 and the driving source (second motor 32) that moves the set guide 23. Accordingly, the rotation of the feed roller 10 and the movement of the set guide 23 may be independent from each other.

Moreover, the medium feeder 3 in the present embodiment includes the transportation rollers 12 and 14 that transport the medium fed by the feed roller 10, and the driving source (second motor 32) that moves the set guide 23 also serves as the driving source that drives the transportation rollers 12 and 14. As a result, the medium can be transported without providing a separate driving source (for example, providing a third motor) that drives the transportation rollers 12 and 14. Further, the second motor 32 is configured to adjust the rotation speed by controlling the control unit 35 before the medium fed toward the transportation roller 12 reaches the transportation roller 12 after the medium abuts the abutment section so that the appropriate transportation speed can be performed by the rotation speed of the transportation rollers 12 and 14.

Further, one example of the abutment sections in the medium feeder 3 of the present embodiment is the retard roller 11 that cooperates with the feed roller 10 to hold and separate the medium which is set on the set guide 23. Accordingly, a single sheet of the medium can be separated from the plurality of media which are stacked by the retard roller 11 in an effective manner. In addition, the space S can be prevented from being created on the leading side in the feeding direction A of the medium, thereby reducing occurrence of jams during feeding of the media.

Further, one example of the abutment sections in the medium feeder 3 of the present embodiment is the flap 25 which is switched between the state engaged with the set guide 23 and the state disengaged from the set guide 23 and configured to allow the pressing unit 24 to press the feed roller 10 in the disengaged state, and the flap 25 assumes the disengaged state and is pressed by the medium during feeding of the media by the feed roller 10 so as to be set back downstream in the feeding direction A. As a result, the flap 25 can easily control whether the pressing unit 24 presses the feed roller 10 or not, and the space S can be prevented from being created on the leading side in the feeding direction A of the medium, thereby reducing occurrence of jams during feeding of the media.

Further, the flap 25 is provided with a friction member (friction surface) 26 on the surface that faces the bundle of media G which is set. The friction member 26 is made of a material that improves the friction coefficient to the medium, for example, elastomer such as rubber, or cork, and is adhered to the surface of the flap 25 that faces the bundle of media G which is set via adhesive or a double-faced tape in the present embodiment. In the present embodiment, the flap 25 is made of a resin material.

During feeding of the media, the friction member 26 is in contact with the leading edge of the bundle of media G which is set, and performs a separation function. That is, the friction member 26 serves to suppress the number of sheets of the media that enters at a nip position (separation position) of the medium between the feed roller 10 and the retard roller 11.

In the above embodiment, the medium transportation device according to the present invention has been described as being applied to the image reading apparatus 1. However, the invention is not limited to the above embodiment, and, as described above, can be applied to a recording apparatus having a recording unit that performs recording on a medium (for example, print paper sheet). Examples of the recording unit include an ink jet recording head, and examples of the recording apparatus include facsimile machines and printers. As an example of the configuration of the recording apparatus, the reading unit 17 of FIG. 3 may be replaced with an ink jet recording head, and the reading unit 16 of FIG. 3 may be replaced with a platen that supports a medium.

It should be noted that the present invention is not limited to the above embodiment. Regardless to say, various modifications are contemplated within the scope of the invention as defined in the appended claims, and these should be included in the scope of the present invention. For example, in the present embodiment, the flap 25 as an abutment section is provided on the pressing unit 24. However, the flap 25 may be provided on another component (for example, frame). Further, in the present embodiment, the flap 25 that regulates the leading edge of the bundle of media G which is set is configured to serve as the abutment section during the period when the media are not fed. However, the invention is not limited thereto, and a dedicated component having a function as the abutment section may also be provided. Further, in the present embodiment, the friction surface on the flap 25 is formed of the friction member 26. However, the friction surface may also be formed as a roughened surface by resin molding.

The entire disclosure of Japanese Patent Application No. 2016-129034, filed Jun. 29, 2016 is expressly incorporated by reference herein.

What is claimed is:

1. A feeder comprising:

a setting section in which a plurality of media is set in a stacked state;

a feed roller that feeds the medium set in the setting section in a feeding direction;

an abutment section on which a leading edge of the medium set in the setting section in a feeding direction abuts;

a support section that supports the medium set in the setting section and moves to allow the medium to be in contact with the feed roller during feeding of the media by the feed roller; and a pressing section that is configured to press the medium set in the setting section against the feed roller to apply a force in a stacking direction of the medium, wherein the pressing section is configured to press the medium after a feeding force is applied on the medium in a direction that allows the leading edge to abut on the abutment section during feeding of the media by the feed roller, and wherein a movement speed of the support section is faster before the medium comes into contact with the feed roller than after the medium comes into contact with the feed roller during feeding of the media by the feed roller.

2. The feeder according to claim 1, wherein a first driving source that rotates the feed roller and a second driving source that moves the support section are different.

3. The feeder according to claim 2, further comprising a transportation roller that transports the medium which is fed by the feed roller, wherein the second driving source also rotates the transportation roller.

4. The feeder according to claim 1, wherein the feed roller is driven before the support section moves during feeding of the media by the feed roller.

5. The feeder according to claim 1, wherein the abutment section is a separating roller that cooperates with the feed roller to hold and separate the medium set in the setting section.

6. The feeder according to claim 5, further comprising a flap that is switched between a state engaged with the support section and disengaged from the support section and configured to allow the pressing section to press the medium against the feed roller in the disengaged state, the flap assuming the disengaged state and being pressed by the medium during feeding of the media by the feed roller so as to be set back downstream in the feeding direction, wherein a rotation speed of the feed roller is faster when the flap is in the state disengaged from the support section than when the flap is in the state engaged with the support section.

7. The feeder according to claim 1, wherein the abutment section is a flap that is switched between a state engaged with the support section and disengaged from the support section and configured to allow the pressing section to press the feed roller in the disengaged state, the flap assuming the disengaged state and being pressed by the medium during feeding of the media by the feed roller so as to be set back downstream in the feeding direction.

8. An image reading apparatus comprising:

a reading unit that reads an image formed on the medium; and the feeder according to claim 1 that feeds the medium to the reading unit.

9. A recording apparatus comprising:

a recording unit that performs recording on the medium; and the feeder according to claim 1 that feeds the medium to the recording unit.

* * * * *